US006705221B2

(12) United States Patent
Stephan

(10) Patent No.: US 6,705,221 B2
(45) Date of Patent: Mar. 16, 2004

(54) DEVICE FOR TURNING OR REVERSING FLAT COPIES IN HALF-REVOLUTION SHEET-PROCESSING MACHINES

(75) Inventor: Günter Stephan, Wiesloch (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/053,434

(22) Filed: Jan. 18, 2002

(65) Prior Publication Data

US 2002/0092432 A1 Jul. 18, 2002

(30) Foreign Application Priority Data

Jan. 18, 2001 (DE) ..... 101 02 080

(51) Int. Cl.[7] ..... B41F 5/02

(52) U.S. Cl. ..... 101/230; 101/410; 271/225; 271/228; 271/301; 271/204; 271/206; 271/82; 271/902

(58) Field of Search ..... 101/230, 410; 271/225, 228, 301, 204, 206, 82, 902

(56) References Cited

U.S. PATENT DOCUMENTS

| | | | | |
|---|---|---|---|---|
| 4,122,773 A | * | 10/1978 | Wirz | 101/230 |
| 4,165,689 A | | 8/1979 | Giuiuzza | |
| 4,721,041 A | | 1/1988 | Simeth | |
| 4,821,643 A | * | 4/1989 | Wieland | 101/230 |
| 4,930,414 A | | 6/1990 | Wirz | |
| 5,016,529 A | * | 5/1991 | Jahn | 101/211 |
| 5,063,843 A | | 11/1991 | Becker | |
| 5,335,597 A | * | 8/1994 | Helmstadter | 101/485 |
| 5,365,845 A | * | 11/1994 | Becker | 101/230 |
| 5,365,846 A | * | 11/1994 | Becker | 101/230 |
| 5,579,691 A | * | 12/1996 | Voge | 101/246 |
| 5,609,103 A | * | 3/1997 | Stephan et al. | 101/230 |
| 6,089,156 A | | 7/2000 | Stephan | |
| 6,089,157 A | * | 7/2000 | Becker et al. | 101/230 |
| 6,254,094 B1 | * | 7/2001 | Becker et al. | 271/309 |

FOREIGN PATENT DOCUMENTS

| | | |
|---|---|---|
| DE | 26 33 183 | 2/1977 |
| DE | 35 35 694 A1 | 4/1987 |
| DE | 37 10 257 A1 | 10/1988 |
| DE | 37 17 093 A1 | 12/1988 |
| DE | 39 03 093 A1 | 8/1990 |
| DE | 196 15 730 A1 | 10/1997 |

* cited by examiner

*Primary Examiner*—Andrew H. Hirshfeld
*Assistant Examiner*—Andrea H. Evans
(74) *Attorney, Agent, or Firm*—Laurence A. Greenberg; Werner H. Stemer; Ralph E. Locher

(57) ABSTRACT

In a sheet-processing rotary printing machine operatable in recto printing and recto/verso printing modes, there is provided a device for reversing sheets, which includes a transfer drum bounded by two sheet-guiding cylinders, a reversing/storage drum and an additional transport element assigned to the transfer drum, the transfer drum being drivable in opposite directions of rotation in the recto printing and the recto/verso printing modes, and gripper systems actable in both directions of rotation of the transfer drum, the gripper systems being accommodated on an imaginary jacket surface of the transfer drum; a printing unit including the components of the device; and the printing machine being a multicolor printing machine.

21 Claims, 10 Drawing Sheets

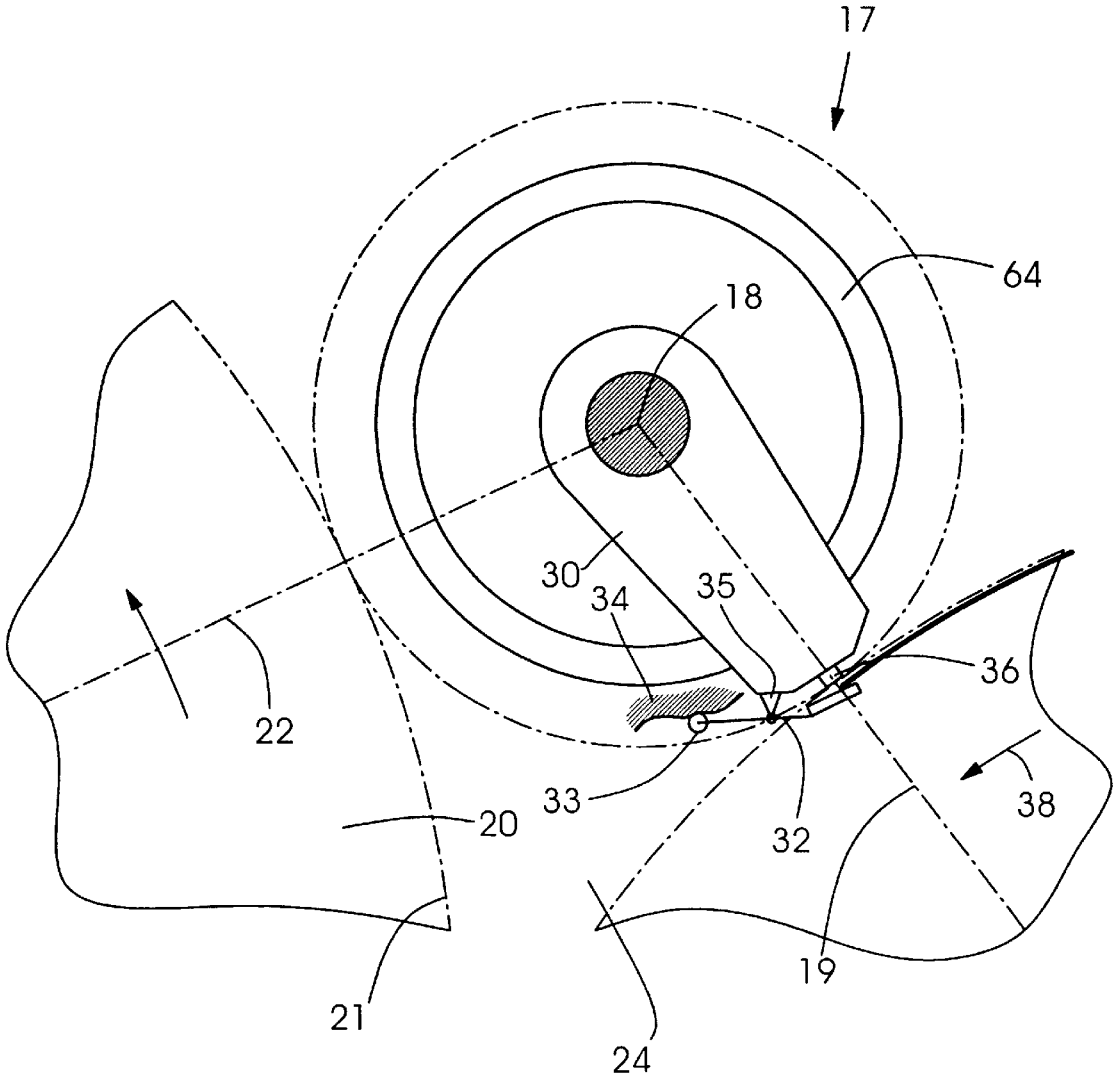
Fig.4.1

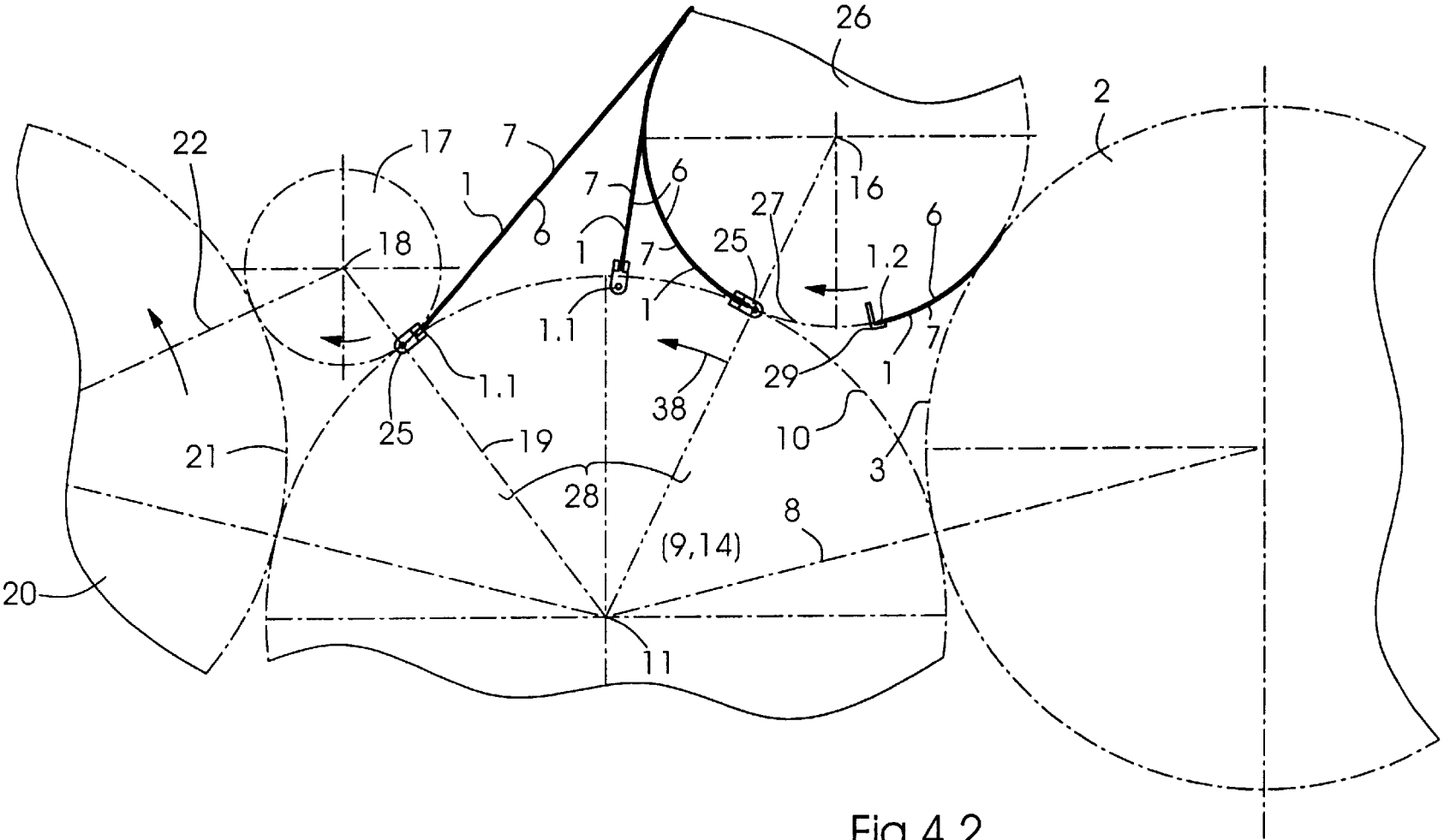
Fig.4.2

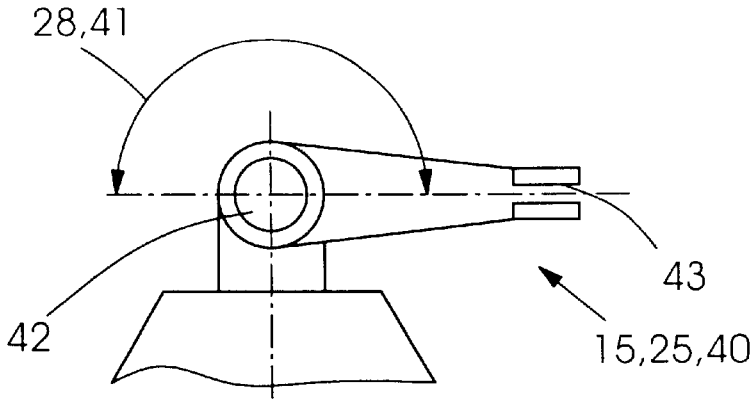
Fig.5.1
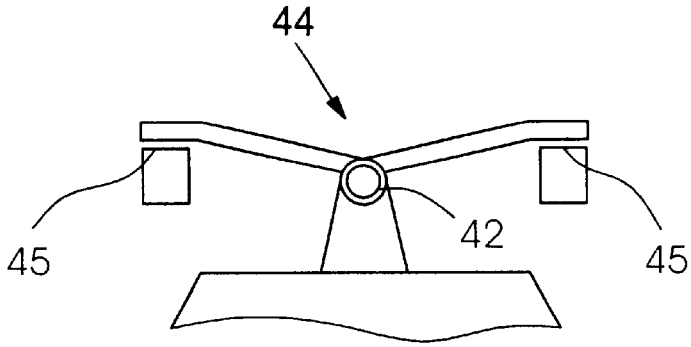
Fig.5.2
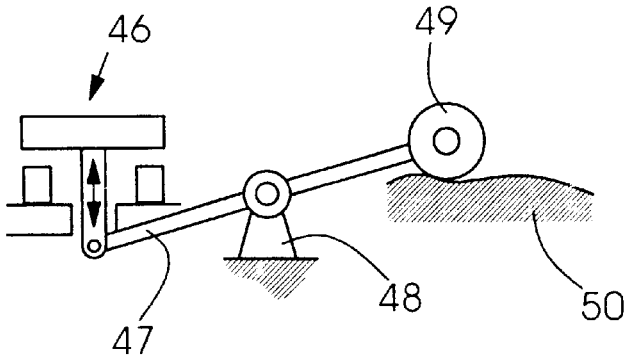
Fig.5.3

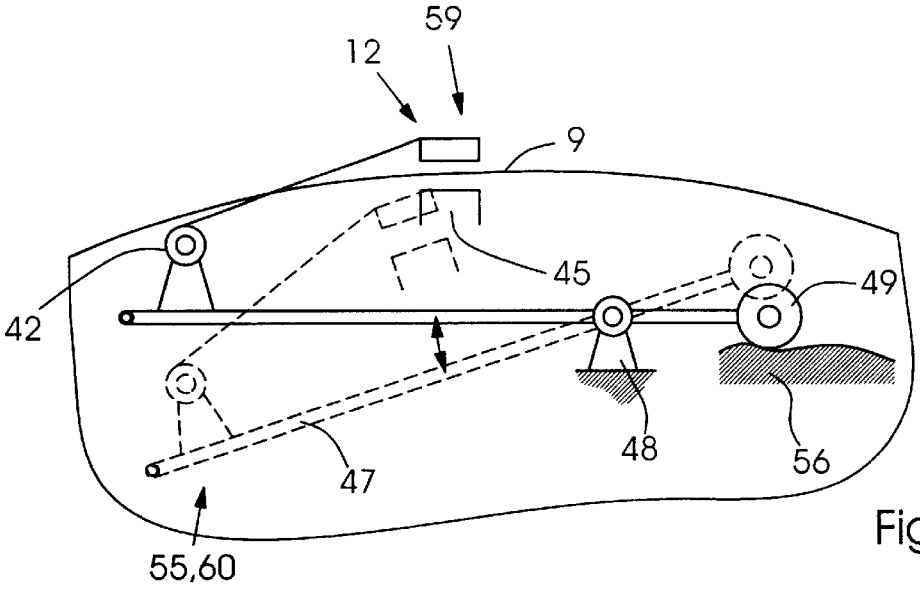
Fig.5.4
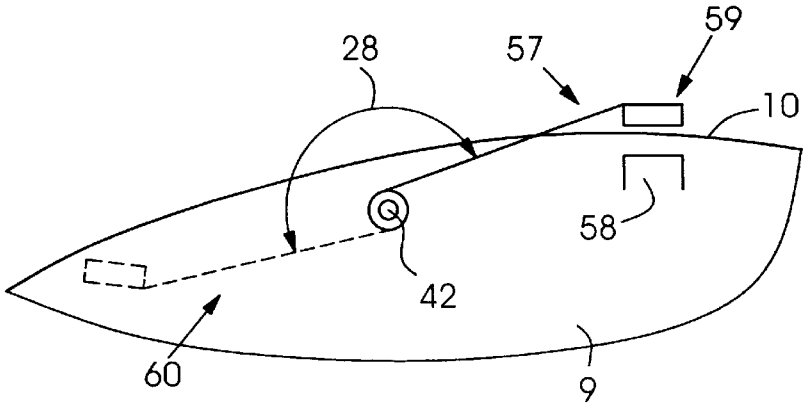
Fig.5.5
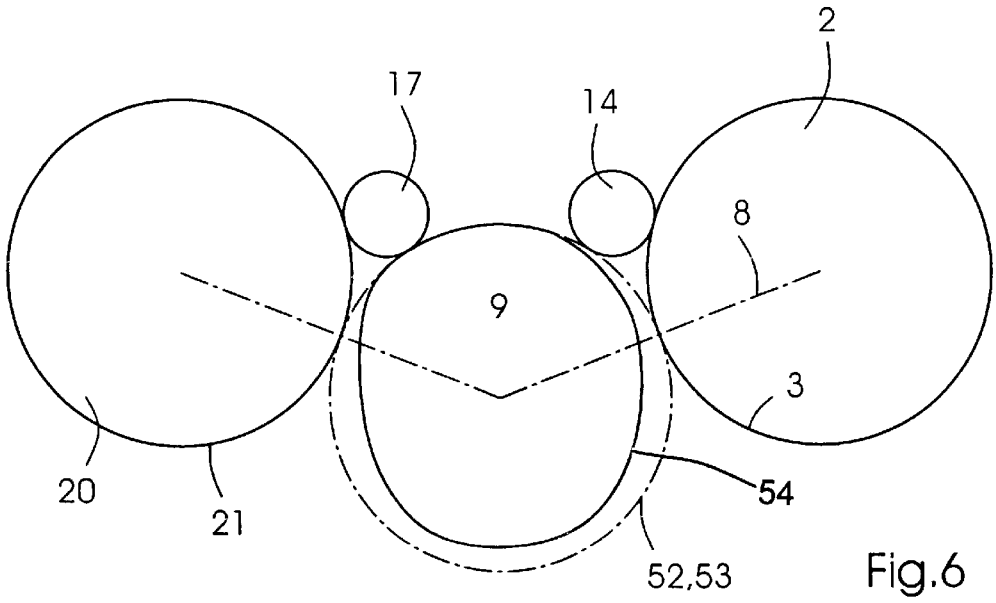
Fig.6

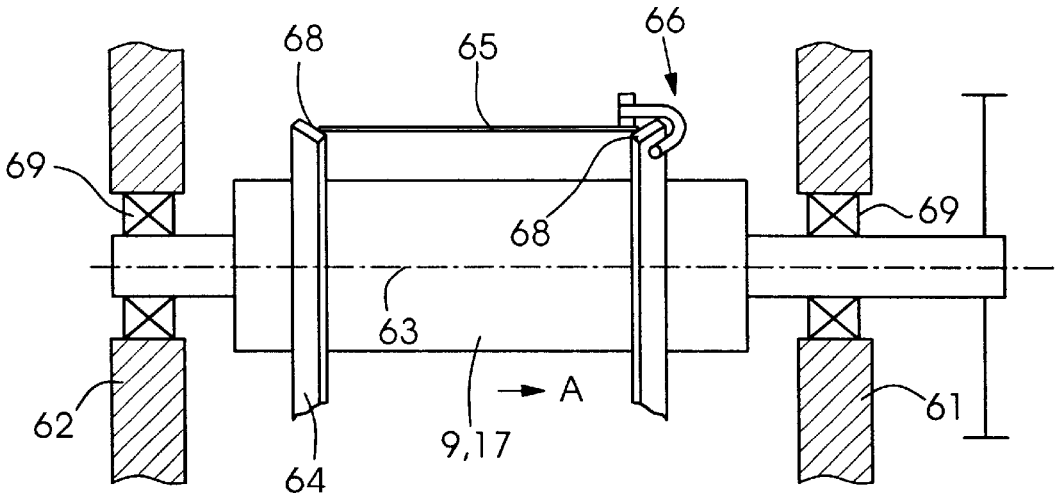
Fig.7
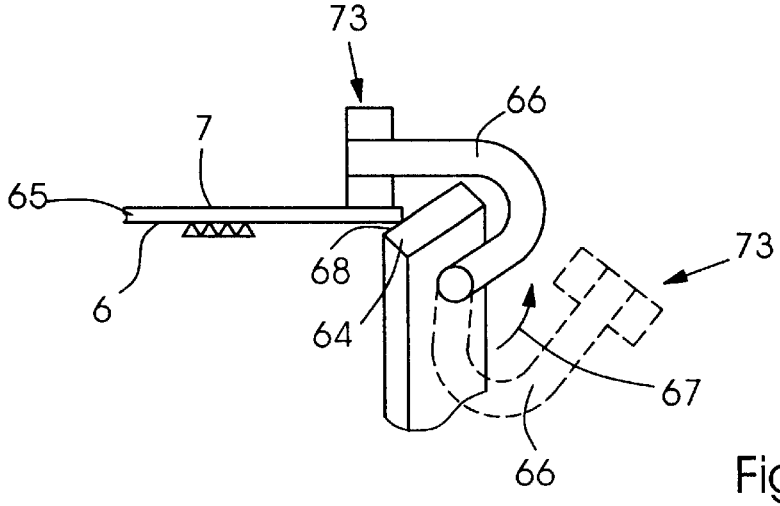
Fig.7.1
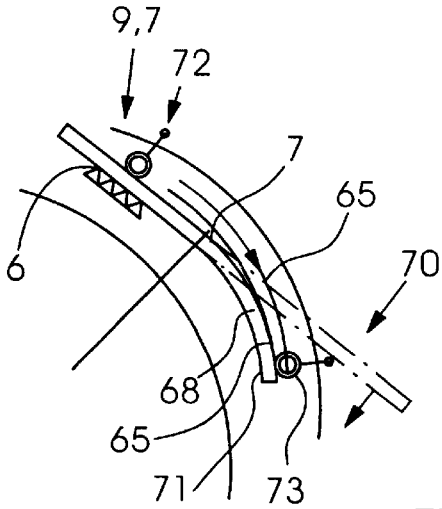
Fig.7.2

DEVICE FOR TURNING OR REVERSING FLAT COPIES IN HALF-REVOLUTION SHEET-PROCESSING MACHINES

BACKGROUND OF THE INVENTION

FIELD OF THE INVENTION

The invention relates to a device for turning or reversing flat copies in half-revolution sheet-processing machines, such as rotary printing machines.

The published German Patent Document DE 37 10 257 A1 is concerned with a sheet-fed rotary printing machine for performing single-sided multicolored printing or first form and perfecter printing, also known as recto/verso printing. A sheet transfer drum is accommodated between sheet-carrying cylinders of two printing units, which are disposed in a travel direction of sheet material; according to the proposal in this document, in order to achieve a construction which, in particular, operates independently of format, the transfer nip between the sheet transfer cylinder and the impression cylinder of the second printing unit is enlarged in comparison with the normal nip width to the impression cylinder of the first printing unit, and the clear interspace is bridged by a gripper system that is movable out of the circumference of the sheet transfer cylinder in order to grip the sheet leading or trailing edge.

The published German Patent Document DE 37 17 093 A1 is also concerned with a rotary printing machine for recto and recto/verso printing. Arranged between the impression cylinders of two printing units, in the travel direction of the sheet, is a sheet transfer cylinder, all of the cylinders having gripper systems assigned thereto. In order to achieve a construction with increased transfer reliability, even in the case of very thick printing material, a sheet feeder arranged downline from the sheet transfer cylinder is provided with a feeder top side configured at least approximately flat and extending somewhat tangentially to the sheet transfer cylinder. While the grippers of the sheet transfer cylinder holding the sheet trailing edge approach the feeder top side, the cylinder pushes the sheet onto the feeder top side with the free sheet leading edge in front, the sheet being lifted by the sheet transfer cylinder off the feeder top side by the trailing edge of the sheet.

The proposed embodiments outlined above are subject to the disadvantage that the sheet material necessarily rests with the respectively freshly printed side thereof on the outer surface of the transfer drum (storage drum) and is tensioned in order to achieve in-register turning or reversing. Damage to the printed image results from this unavoidable relative movement between the drum outer cylindrical surface or jacket and the sheet.

The published German Patent Document DE 196 15 730 A1 is concerned with a turning or reversing device for a printing machine, in particular to a sheet-fed rotary offset printing machine. The turning or reversing device for a printing machine comprises a transfer drum arranged between a first impression cylinder and a second impression cylinder. Below the transfer drum is a register cylinder having a large number of suction openings for holding the sheet by suction; after the gripper device has opened, the register cylinder conveys the sheet in-register into a temporary storage system. In the latter, the sheet is stored temporarily, in an approximately stretched-out form, on a first sheet guide device provided with blower or blast nozzles. A tongs-type turning or reversing gripping device arranged on the transfer drum grips the trailing edge of the sheet deposited in the temporary storage system, and transfers the edge to a conventional gripper device formed on the downline impression cylinder, which then supplies the sheet turned or reversed in this manner to a downline printing nip in order to print the underside of the sheet.

A disadvantage of this method is that operations are not performed with simultaneous gripper closure on the leading and trailing edge of the sheet.

In addition to the possible embodiments outlined from the prior art, the sheet material can also be stored on the impression cylinder. Following printing, the sheet material is stored on the impression cylinder, subsequently gripped by the gripper systems of the transfer drum, and turned or reversed. With regard to the half-revolution machine concept, i.e., constructing the cylinder with twice the circumference of that of the impression cylinder, the printing operation is completed, i.e., the sheets are printed out until, in recto printing mode, the leading edge thereof is transferred to the following transfer drum. For this reason, it is necessary to provide a complete sheet length between the printing point and transfer center line. Should it be possible for the sheet material to be turned or reversed, a further sheet-length space must be provided under the impression cylinder in order to store the sheet.

Reserving a further sheet-length space underneath the impression cylinder necessarily results in a specific relative arrangement of transfer cylinders, i.e., blanket cylinder, impression cylinder and transfer drum, relative to one another. If the necessary installation space upline from the printing point is to remain for the sheet guiding elements necessary to ensure the print quality, a large cylinder diameter is required in relation to the maximum Printing-material length. This entails higher production and manufacturing costs, greater dynamic problems due to the higher masses to be moved and, overall, an increase in the length of printing machines which, in print shops, occupy adjusting or installation area which is tight in any case.

A common factor in all of the heretofore proposed constructions is that they require a different configuration of the transfer drum in the turning or reversing printing unit compared with the configuration of the transfer drum in the other printing units. This results in considerable problems in the recto printing mode, wherein a multicolor rotary printing machine is also intended to be operated, in particular when processing a relatively stiff printing material such as pasteboard or cardboard.

SUMMARY OF THE INVENTION

Starting from the prior art outlined hereinabove, it is an object of the invention to provide a device for reversing flat copies in half-revolution sheet-processing machines, the device utilizing simultaneous gripper closure of the sheet material at the leading and trailing edge of the respective sheets, and operating with the greatest accuracy.

With the foregoing and other objects in view, there is provided, in accordance with one aspect of the invention, in a sheet-processing rotary printing machine operatable in recto printing and recto/verso printing modes, a device for reversing sheets, comprising a transfer drum bounded by two sheet-guiding cylinders, a reversing/storage drum and an additional transport element assigned to the transfer drum, the transfer drum being drivable in opposite directions of rotation in the recto printing and the recto/verso printing modes, and gripper systems actable in both directions of rotation of the transfer drum, the gripper systems being in accommodated on an imaginary jacket surface of the transfer drum.

In accordance with another feature of the invention, the reversing/storage drum and the additional transport element, in the recto printing mode, are located outside a transport path of a sheet on the sheet-guiding cylinders.

In accordance with a further feature of the invention, a transport path of a sheet, in the recto/verso printing mode, is located on a side of a jacket surface of the transfer drum, which is located opposite the transport path of the sheet in the recto printing mode.

In accordance with an added feature of the invention, the transfer drum has a contour set back with respect to an enveloping curve of the gripper systems.

In accordance with an additional feature of the invention, the reversing/storage drum and the additional transport element are driven only in the recto/verso printing mode, and are stopped in the recto printing mode.

In accordance with yet another feature of the invention, the sheet-reversing device includes a first one of the sheet-guiding cylinders, the transfer drum drivable in a direction opposite to the direction of rotation of the recto printing mode, the reversing/storage drum and the additional transport element engaging with the second one of the sheet-guiding cylinders serve for transporting and reversing the sheet in the recto/verso printing mode.

In accordance with yet a further feature of the invention, in the recto/verso printing mode, the transport path of the sheet is over a first one of the sheet-guiding cylinders, a single-revolution transfer cylinder, the transfer drum drivable in a direction opposite to the direction of rotation of the recto printing mode, and the additional transport element functioning as a reversing drum.

In accordance with yet an added feature of the invention, in the recto/verso printing mode, the transport path of the sheet extends from a first one of the sheet-guiding cylinders over a storage drum, the transfer drum functioning as a reversing drum, over the additional transport element to the jacket surface of a second one of the sheet-guiding cylinders.

In accordance with yet an additional feature of the invention, a first one of the sheet-guiding cylinders, the transfer drum and a second one of the sheet-guiding cylinders are constructed as half-revolution cylinders.

In accordance with still another feature of the invention, the reversing/storage drum and the additional transport element are constructed by a technique selected from the group thereof consisting of a single revolution and a division by integers in relation to the diameter of a printing-form cylinder.

In accordance with still a further feature of the invention, the gripper systems act on both sides on the transfer drum, and are formed as tongs-type gripper systems for executing a 180° pivoting movement.

In accordance with still an added feature of the invention, the gripper systems act on both sides on the transfer drum and are formed, respectively, as a double gripper with two gripper fingers drivable about a common shaft.

In accordance with still an additional feature of the invention, the gripper systems act on both sides on the transfer drum and are formed, respectively, as a cam-controlled, vertically displaceable T-shaped gripper to which two gripper pad surfaces are assigned.

In accordance with another feature of the invention, the respective gripper system on the transfer drum is formed as a gripper system which is activatable in the recto printing mode, and is settable into a dipped position in the recto/verso printing mode.

In accordance with a further feature of the invention, the respective gripper system of the transfer drum is formed as a folding gripper system which is pivotable about a pivot shaft.

In accordance with an added feature of the invention, a supporting element having an inclined contact face is accommodated on at least one of the transfer drum and the additional transport element, and including a catching element activatable for setting relatively stiff sheet material against the supporting element.

In accordance with an additional feature of the invention, the relatively stiff sheet material is transferrable by the catching device from a stretched position into a wound-up position on the supporting element.

In accordance with yet another feature of the invention, in the recto printing mode, a drive to one of the sheet-guiding cylinders is provided via a gear train.

In accordance with yet a further feature of the invention, in the recto/verso printing mode, a drive to the other of the sheet-guiding cylinders is provided via another gear train having a coupling element.

In accordance with another aspect of the invention, there is provided a printing unit for reversing sheet material, comprising a transfer drum bounded by two sheet-guiding cylinders, a reversing/storage drum and an additional transport element assigned to the transfer drum, the transfer drum being drivable in opposite directions of rotation in recto printing and recto/verso printing modes, and gripper systems actable in both directions of rotation of the transfer drum, the gripper systems being accommodated on an imaginary jacket surface of the transfer drum.

In accordance with a concomitant aspect of the invention, there is provided a multicolor rotary printing machine having a device for reversing sheets, comprising a transfer drum bounded by two sheet-guiding cylinders, a reversing/storage drum and an additional transport element assigned to the transfer drum, the transfer drum being drivable in opposite directions of rotation in recto printing and recto/verso printing modes, and gripper systems actable in both directions of rotation of the transfer drum, the gripper systems being accommodated on an imaginary jacket surface of the transfer drum.

The advantages of the invention are primarily to be seen in the fact that the shaping of the sheet-guiding cylinder functioning as a transfer drum in the reversing printing unit is identical to that of the transfer drum in an exclusively recto printing unit. Thus, the sheet transfer path in the recto printing mode of the rotary printing machine lies outside all the components required to reverse or turn the sheet. The transport path of the sheet material, whether it is paper of any grammage or else relatively stiff cardboard or pasteboard, in the recto/verso printing mode of the reversing printing unit is located on the opposite side of the sheet-guiding cylinder functioning as a transfer cylinder. The transfer drum, which has a direction of rotation, for example, in the recto printing mode corresponding to the clockwise direction, is operated in a counterclockwise direction of rotation in the recto/verso printing mode and comprises gripper systems which act on both sides, so that sheet material can be fixed to the transfer drum in one and the other direction of rotation.

In further refinement of the idea upon which the invention is based, the reversing/storage drum and an additional transport element can be arranged outside the transport path of the sheet material on the sheet-guiding cylinder in the recto printing mode. The result, therefore, even in the reversing printing unit in the recto printing mode of the rotation, is a sheet passage which corresponds to the greatest extent to the sheet run through a pure recto printing unit, so that, in the recto printing mode, the reversing printing unit is printed with the same high quality standard as pure recto printing units.

The transport path of the sheet material in the recto/verso printing mode is provided on the side of the jacket surface of the transfer drum between the sheet-guiding drums, the side being opposite the transport path of the sheet in the recto printing mode. By configuring the transfer drum as a cylinder that can be driven in both directions of rotation, the sheet transport path in the recto printing mode can be decoupled strictly from the sheet transport path in recto/verso printing mode. In order to achieve collision-free transport, even of relatively stiff printing material, through the reversing printing unit configured in accordance with the invention, the contour of the transfer drum is configured so as to be set back in relation to the gripper systems accommodated on the outer or jacket surface thereof, so that the diversion and secure storage of the sheet material to be reversed or turned is ensured on the transfer drum during the reversing or turning action.

With the configuration of a reversing or turning printing unit proposed in accordance with the invention for a sheet-processing rotary printing machine, reversing/storage drums and an additionally arranged transport element can be driven only in the recto/verso operating mode, while in pure recto printing operation of the reversing printing unit these components can be stopped. As a result, firstly drive power can be saved, and secondly the pure recto printing operation of a reversing printing unit configured in accordance with the invention is not influenced by components required for the recto/verso mode.

In the recto/verso printing mode, the transport path of the sheet material, whether the printing material is in paper form of lighter or heavier grammages, or printing material in the form of relatively stiff cardboard or pasteboard, and the reversing or turning thereof, can run over a first sheet-guiding cylinder, a transfer cylinder rotating in a direction opposite to the direction of rotation of the recto printing mode, and over a reversing drum and the additional transport unit, which can likewise be of cylindrical configuration, and run to the second sheet-guiding cylinder. In the recto/verso printing mode of the reversing printing unit proposed in accordance with the invention, a further transport path can run over the first sheet-guiding cylinder; can further run over a single-revolution transfer cylinder and over the transfer drum rotating in the direction opposite to the direction of rotation in the recto printing mode, through an additional transport cylinder functioning as a reversing drum in this alternative embodiment. Furthermore, a further transport possibility for the sheet material in the recto/verso printing mode is provided by the transport of the sheet from the first sheet-guiding cylinder to a storage drum, from there to a transfer drum functioning as a reversing drum, from this to an additional transport element, which can likewise be of cylindrical configuration, to the outer or jacket surface of the second sheet-guiding cylinder.

In order to achieve identical guidance of the sheet material, whether it is paper of lighter and heavier grammages or relatively stiff cardboard or pasteboard, through the pure recto printing units and the reversing printing unit configured in accordance with the invention, the first sheet-guiding cylinder, the transfer drum and the second sheet-guiding cylinder are preferably constructed as half-revolution cylinders, i.e., with twice the diameter in comparison with the printing-form cylinder.

Reversing/storage drums and the additional transport element, likewise of cylindrical configuration, may therefore be constructed with single revolution or with an integer divider in relation to the diameter of the printing form cylinder. This is economical with respect to installation space and is not critical with respect to the yet unprinted side of the sheet material, because no smearing phenomena can occur.

Accommodated on the transfer drum bounded in the reversing printing unit by two half-revolution sheet-guiding cylinders are gripper systems acting on both sides which, in one alternative configuration are tongs-type grippers and are able to carry out a pivoting movement covering about 180°. In addition to a tongs-type gripper carrying out a 180° pivoting movement, the gripper systems that act on both sides on the transfer drum can also be constructed as double grippers with two mutually opposed gripper arms which can be driven separately on a common axis. The gripper fingers of the double gripper cooperate, respectively, with a separate gripper pad surface. In addition, it is conceivable to construct the gripper system acting on both sides on the outer or jacket surface of the transfer drum also as cam-controlled T-shaped grippers which can be displaced vertically up and down, with which likewise two mutually separate gripper pad surfaces can be associated. The vertical movement of the T-shaped gripper on the outer or jacket surface of the transfer drum may be implemented, for example, by a lever transmission performing a pivoting movement about a fixed bearing, which can be generated by a roller/cam drive.

In order to avoid collisions with other machine components, the gripper systems of the transfer drum proposed in accordance with the invention in the reversing printing unit may be configured as systems which can be activated in recto printing mode, i.e., can be extended, and with gripper systems which can be set into a dipped position in the recto/verso operating mode. To this end, the gripper systems on the outer or jacket surface of the transfer drum can be constructed so that they can be retracted as a whole into the outer or jacket surface of the transfer drum; finally, it is also possible to configure the gripper fingers about a pivot axis so that a folding movement describing a 180° circular arc is possible.

With all the gripper systems described hereinbefore, reverse acceleration of the sheet material, whether it is paper or relatively stiff cardboard or pasteboard, can be carried out over an extended time period, because the transport path of the sheet material runs without collision as a secant through the theoretical gripper circle, i.e., the enveloping curve of the transfer drum and of the additional transport element. Inherent in this alternative embodiment of the sheet material during reversing or turning is a considerably gentler accelerating action; a further positive side effect of this guidance of the sheet material during turning or reversing is the achievement of higher speeds in the recto/verso printing mode of the multicolor rotary printing machine equipped with the reversing or turning printing unit configured in accordance with the invention. The described gripper systems dip into the circular contour of the transfer drum when in a position in relation to the two adjacent cylinders, wherein a collision is threatened.

In a preferred alternative embodiment of the transfer drum and/or of the additional transport element within the reversing printing unit, a conical support can be fitted both to the transfer drum and to the additional transport element, with which in particular the side edges of relatively stiff cardboard or pasteboard material can be supported. By catching devices cooperating with the supporting element having conical supporting surfaces, relatively stiff sheet material can be pressed against the contact surfaces of the conical supporting elements, in order to counteract excessive stretching and therefore the risk of collision with the next sheet stored on a cylinder. By the activatable catching hooks, in particular the trailing edge of relatively stiff cardboard or pasteboard materials is held on the radius of the cylinder, i.e., brought from a stretched position effected by the stiffness inherent in this printing material into a wound-up position, i.e., a slightly curved position set against the outer or jacket surface. The supporting element arrangement, having inclined supporting surfaces, can be used as well on the transfer drum; in another alternative embodiment, the additional transport element, with a reduced diameter due to the installation space, can be provided with a device that influences the stretched position of relatively stiff material.

On the reversing printing unit configured in accordance with the invention, both a gear train for the recto printing mode and a gear train for the recto/verso printing mode are provided. In the recto printing mode, the drive to the second sheet-guiding cylinder is provided via a first gear train, from which the gears of the reversing drum and of the additional transport element are disengaged. In the recto/verso printing mode, the drive to the second sheet-guiding cylinder is provided via a gear train lying parallel with the first gear train, wherein the drive from the first sheet-guiding cylinder is transferred, for example, via the gear driving the reversing drum, to a further gear mounted on the shaft of the transfer drum, and therefrom to the gear of the additional transport element which, in turn, drives the drive gear of the second sheet-guiding cylinder. All the shafts of the foregoing cylinders are mounted with low friction in rolling-contact bearings in the side walls of the reversing or turning printing unit. In order to shift or change the gear trains over in accordance with the selected operating mode of the reversing or turning printing unit, a coupling element or clutch is provided in the gear train, preferably on the shaft of the transfer drum, with which the changeover from the recto printing mode to the recto/verso printing mode can be performed by coupling between direct and indirect drive via the reversing or turning drum on the transfer drum. At the same time, assurance is offered that simultaneous rotation of the driving systems in relation to one another is carried out in such a manner that the reversing drum grips the end of the sheet lying on the impression cylinder precisely as a function of the format. In the recto printing mode, the changeover is effected so that the verso printing components in a rest position of the reversing drum and additional transport system are separated, and the transfer drum is coupled directly into the drive train in synchronism with the impression cylinder grippers.

The configuration of a reversing printing unit proposed in accordance with the invention is preferably used in multicolor rotary printing machines wherein, depending upon the alternative construction of the sheet-processing machine, a number of pure recto printing units is present, and the reversing printing unit, wherein the pure recto printing operation and the recto/verso printing operation are possible, is connected therebetween. By virtue of the compatibly constructed cylinder diameters, the sheet material to be processed undergoes sheet guidance in the reversing printing unit configured in accordance with the invention when in the recto printing mode, this sheet guidance corresponding to the greatest possible extent to the sheet guidance in pure recto printing units. Due to the separation of the transport paths of the sheet material, in the pure recto printing mode, from the transport path of the sheet material, in the recto/verso printing mode, in the reversing printing unit configured in accordance with the invention, mutual influences in the operating modes are ruled out.

In the recto printing operation, the transport of the sheet material that is not to be reversed is carried out via an optimized transfer drum, whereas, when a changeover or shift is made to the recto/verso printing mode, the cylinder components best suited for this operating mode are connected together.

Other features which are considered as characteristic for the invention are set forth in the appended claims.

Although the invention is illustrated and described herein as embodied in a device for reversing or turning flat copies in half-revolution sheet-processing machines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

BRIEF DESCRIPTION OF THE DRAWINGS

FIG. 4.1 is an enlarged fragmentary view of FIG. 1 showing an additional transport element in greater detail;

FIG. 4.2 is a view similar to that of FIG. 1, but showing a different embodiment of a half-revolution transfer drum functioning as a turning or reversing drum;

FIGS. 5.1 to 5.5 are diagrammatic side elevational views of gripper systems acting from both sides on the transfer drum;

FIG. 6 is a diagrammatic side elevational view of the cylinder configuration according to the invention, showing the paths of the gripper system on the circumference of the transfer drum, which are set in recto printing mode and in recto/verso printing mode;

FIG. 7 is a diagrammatic side elevational view, partly in section, illustrating a conical supporting element on the transfer drum and/or an additional transport element;

FIGS. 7.1 and 7.2 are diagrammatic front elevational and side elevational views, respectively, of a catching or capturing element according to the invention;

DESCRIPTION OF THE PREFERRED EMBODIMENTS

Figure 1:
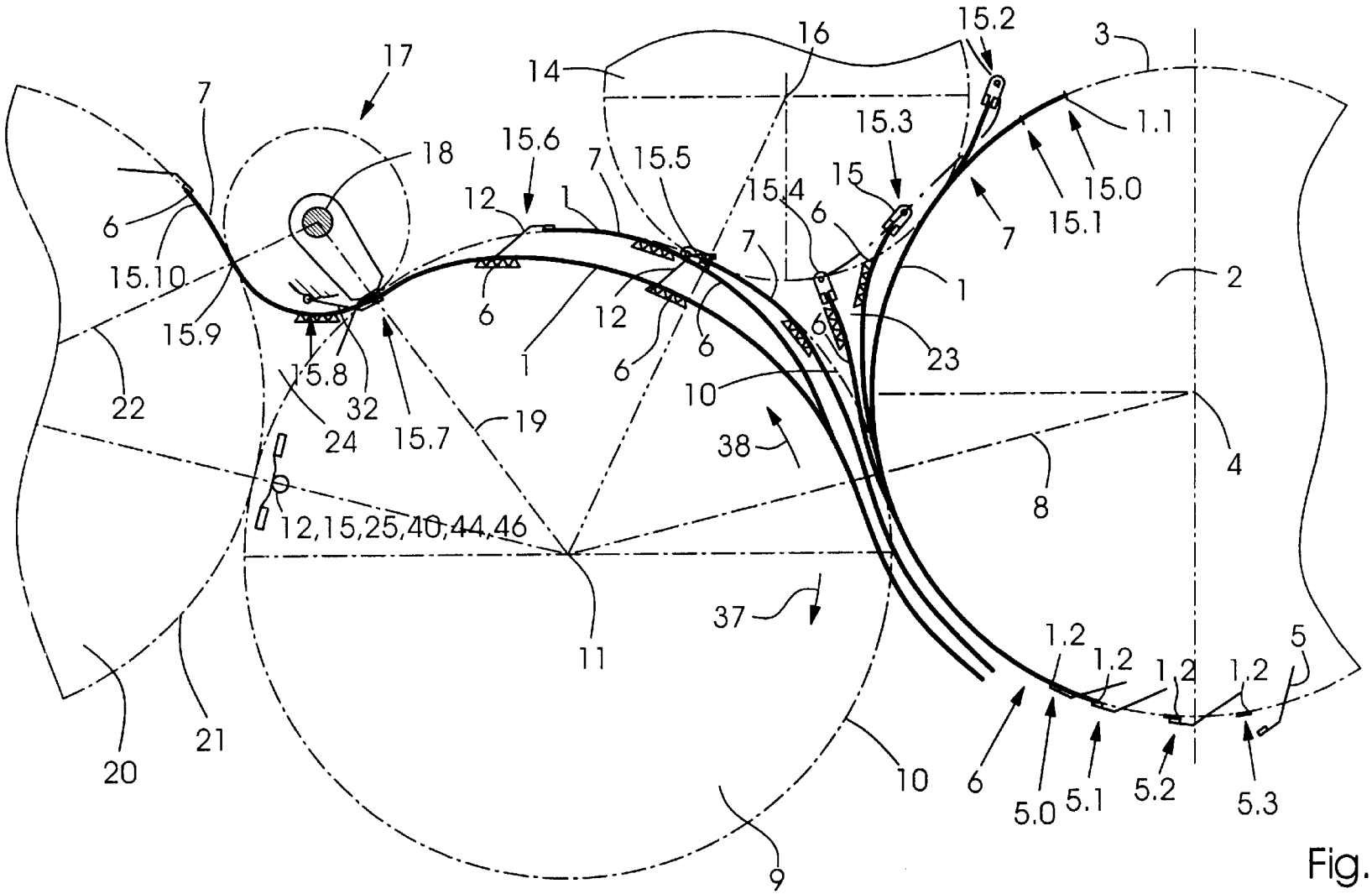
FIG. 1 is a diagrammatic side elevational view of a cylinder configuration of a turning or reversing printing unit according to the invention having a half-revolution sheet-guiding cylinder.

Referring now to the drawings and, first, particularly to FIG. 1 thereof, there is shown therein a first cylinder configuration of a turning or reversing printing unit configured in accordance with the invention with half-revolution sheet-guiding cylinders.

FIG. 1 shows a first sheet-guiding cylinder 2, on the cylindrical outer or jacket surface 3 of which a sheet 1 is resting. The sheet 1 has a trailing edge 1.1 and a leading edge 1.2. The first sheet-guiding cylinder 2 rotates about a rotational axis 4, the sheet 1 resting with the underside 7 thereof on the outer surface 3 of the first sheet-guiding cylinder 2 and, with the printed upper side 6 thereof, which may already be printed in four colors, directed towards a turning or reversing drum 14. The leading edge 1.2 of the sheet 1 is gripped by a gripper system 5 assigned to the outer surface 3 of the first sheet-guiding cylinder 2. FIG. 1 shows in detail individual phases in the movement of the sheet leading edge 1.2, as the trailing edge 1.1 of the sheet 1 to be turned is picked up by a reversing-drum gripper 15 on a reversing drum 14 of single-revolution construction.

The sheet 1 is initially stored on the outer cylindrical or jacket surface 3 of the first sheet-guiding cylinder 2. In order to be able to perform the storage, the leading edge 1.2 is held in the gripper system 5 of the first sheet-guiding cylinder 2, until it is beyond a transfer center line 8 and is transported into the position shown in FIG. 1. The sheet trailing edge 1.1 on the outer or jacket surface 3 of the first sheet-guiding cylinder 2 is at 15.0. At the instant of time represented at 15.1, the trailing edge 1.1 of the sheet 1 is gripped by the reversing-drum gripper 15 by a suction element, illustrated only diagrammatically in FIG. 1, and is lifted off the outer or jacket surface 3 of the first sheet-guiding cylinder 2. The sheet 1 is then gripped towards the reference position of the leading edge 1.2, is stretched in this gripper system by the gripper system 5 on the outer or jacket surface 3 of the first sheet-guiding cylinder 2 and is aligned while maintaining register. At this instant, the sheet trailing edge 1.1 and the sheet leading edge 1.2, respectively, are gripped by a fixing system. In the position 15.2 of the trailing edge 1.1 of the sheet 1, the trailing edge 1.1 of the aligned sheet is transferred from the suction element to the reversing-drum gripper 15 of the reversing drum 14. At this time, the holding system 5 on the first sheet-guiding cylinder 2 assumes the position 5.1 thereof, i.e., the holding system 5 opens to release the sheet leading edge 1.2. The reversing-drum gripper system 15 then transfers the trailing edge 1.1 of the sheet 1 into a position 15.3. The leading edge 1.2 of the sheet 1 remains further on the outer or jacket surface 3 of the first sheet-guiding cylinder 2 (position 5.2). On a collision-free path 31 (note FIG. 2) past the outer or jacket surface 3 of the first sheet-guiding cylinder 2, the old trailing edge 1.1 of the sheet, which now represents the new sheet leading edge, is transferred into a position 15.4. At this time, the new sheet trailing edge 1.1, i.e., the old sheet leading edge 1.2, is located in position 5.3 under the opened gripper system 5 on the outer or jacket surface 3 of the first sheet-guiding cylinder 2. In the position 15.4, the reversing-drum gripper 15 of the reversing drum 14, which rotates about the rotational axis 16, has performed a pivoting movement corresponding approximately to a 90° arc. In a manner corresponding to the rotational movement of the reversing drum 14 about the rotational axis 16 thereof, the old sheet trailing edge 1.1 passes into the position 15.5, with a further 90° pivoting movement. From the position 15.3 of the sheet trailing edge to the position 15.5 of the old sheet trailing edge 1.1, the reversing-drum gripper guided on the circumferential surface on the collision-free path 31 has completed a 180° pivoting movement and is now located on the transfer center line 13, which is formed between the rotational axis 11 of a transfer drum 9 and the rotational axis 16 of the reversing drum 14. At this time, the underside 7 of the sheet 1 is directed to the outside, while the printed upper side, which, for example, can be printed in two, three or four colors and can be finished, is directed towards the rotational axis 11 of the transfer drum 9.

According to FIG. 1, the transfer drum 9 rotates in a counterclockwise direction represented by the curved arrow 38 in the recto/verso mode when turning or reversing the sheet material 1. The gripper systems 12 accommodated on the outer cylindrical or jacket surface of the transfer drum 9 describe an enveloping curve 10, it being possible for the outer cylindrical or jacket surface of the transfer drum 11 itself to be formed with a set-back contour, in order to distribute the return or reverse acceleration of the sheet material 1 over an extended time period during the turning or reversing action. The transport path of the sheet 1 passes as a secant through the theoretical gripper circle 10, i.e., the enveloping curve of the transfer drum 9 and an additional transport element 17 disposed downline from the latter. As a result, the accelerating actions are considerably gentler, and the mechanical stresses, in particular the tendency of the sheet material to flutter, are reduced considerably. Furthermore, in the recto/verso operating mode, higher speeds may be achieved.

On the transfer drum configured with a set-back contour, the sheet material 1 is gripped by a holding element 12 and conveyed into the position 15.6. The leading edge, i.e., the old trailing edge 1.1 of the sheet 1, gripped by the holding element 12, is at the position 15.6. The region adjoining the clamping point of the sheet 1 projects into the enveloping curve 10, i.e., the theoretical gripper circle of the transfer drum 9. From the position 15.6, the old sheet trailing edge 1.1 of the sheet 1 is conveyed into the position 15.7, wherein it rests on a transfer center line 19. The transfer center line 19 is formed between the rotational axis 11 of the transfer center line 19 and the rotational axis 18 of an additional transport element 17. Gripped by gripping elements 32 on the circumference of the additional transport element 17, the sheet 1 is deflected through about 90° and conveyed onwardly into the position 15.8. Finally, the old trailing edge 1.1 of the sheet 1 reaches the position 15.9, wherein it reaches a transfer center line 22 between the rotational axis 18 of the additional conveying element 17 and the rotational axis (not shown here) of the second sheet-guiding cylinder 20. Gripped by holding elements accommodated on this second sheet-guiding cylinder 20, the sheet 1 lies turned or reversed on the outer cylindrical or jacket surface 21 of the second sheet-guiding cylinder 20. The previously printed upper side 6 is now directed towards the outer cylindrical or jacket surface 21 of the second sheet-guiding cylinder 20, while the yet unprinted underside 7 of the sheet 1 is directed outwardly and can be processed in succeeding pure recto printing units.

On the circumference of the theoretical gripper circle, i.e., the enveloping curve 10 of the transfer drum 9, it is possible to accommodate gripper systems 12, 15, 25, 40, 44, 46, acting on both sides, and described more thoroughly hereinbelow. In addition, on the theoretical gripper circle 10 of the transfer drum 9, it is also possible to accommodate gripper systems 12 which can be set back below the enveloping curve 10 so as to be collision-free in specific rotational regions of the transfer drum 9 and can either be set back below the theoretical gripper circle 10 or can be folded through 180°. This alternative embodiment is also described more thoroughly hereinbelow.

A first wedge-shaped region or pocket 23 is formed by circumferential surfaces of the first sheet-guiding cylinder 2, the transfer drum 3 and the turning or reversing drum 14. A further wedge-shaped region or pocket 24 is bounded on one it side by the theoretical gripper circle 10 of the transfer drum 9, also by the outer cylindrical or jacket surface 21 of the second sheet-guiding cylinder 20, and finally by the enveloping curve of the additional transport element 17.

Figure 2:
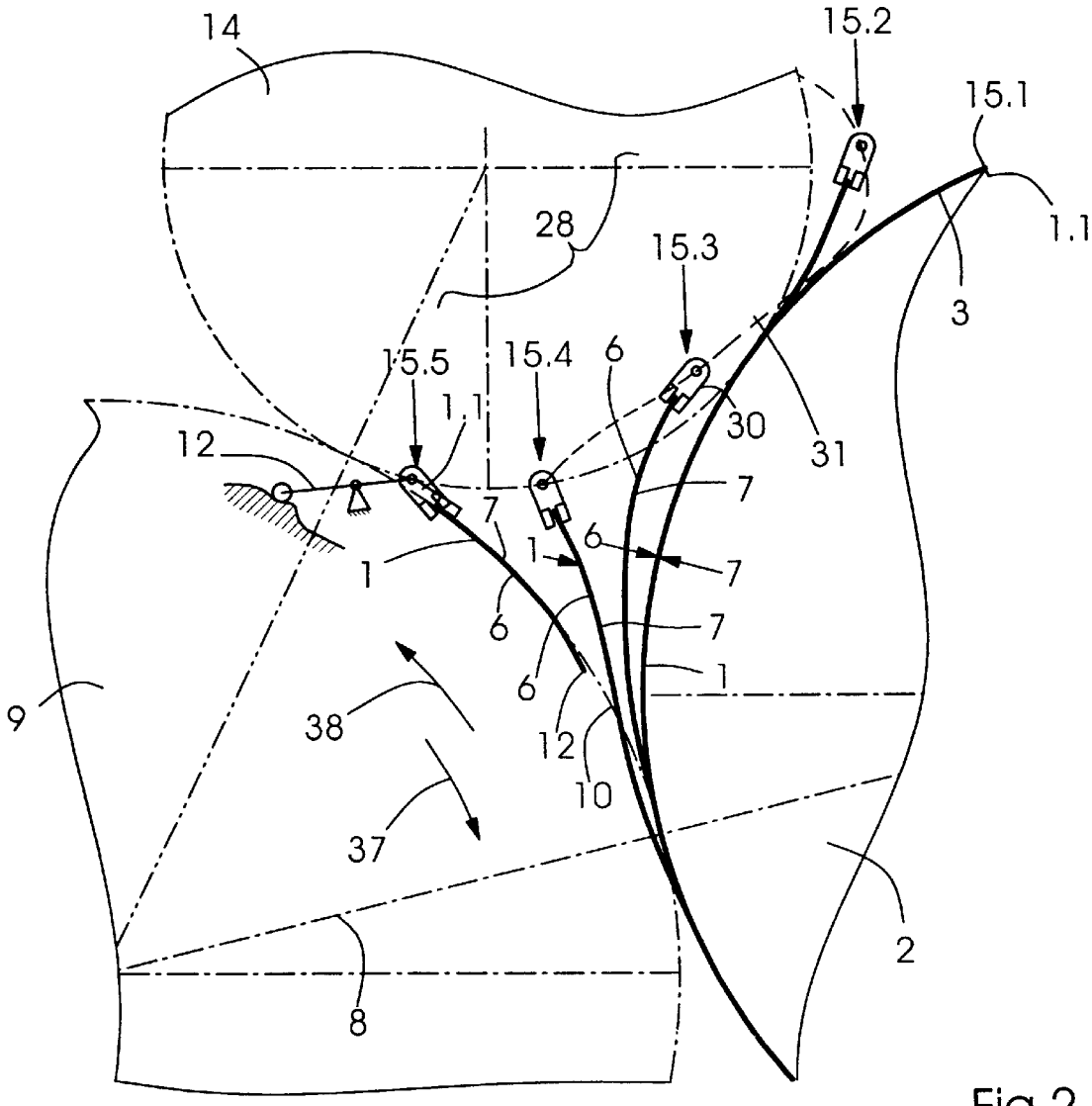
FIG. 2 is an enlarged fragmentary view of FIG. 1 illustrating a cylinder wedge-shaped region.

FIG. 2 shows in detail an enlarged reproduction of the first cylinder wedge-shaped region or pocket.

The sheet trailing edge 1.1 of the sheet 1, which rests with the underside 7 thereof on the outer cylindrical or jacket surface 3 of the first sheet-guiding cylinder 2, is gripped in the position 15.1 by a suction element, reproduced only diagrammatically here, and transferred to a gripper 15 belonging to the turning or reversing drum 14. The reversing-drum gripper gripping the trailing edge 1.1 of the sheet 1 guides the trailing edge of the sheet to be taken off the outer cylindrical or jacket surface 3 of the first sheet-guiding cylinder 2 into the position 15.2, 15.3 and 15.4 and, in the process, describes a collision-free path 31 that is set back behind the enveloping curve of the turning or reversing drum 14. In the position 15.4, the trailing edge 1.1 of the sheet 1 has again reached the enveloping curve of the turning or reversing drum 14, before it is transferred, in the position 15.5, to the holding elements 12 on the theoretical gripper circle 10 of the transfer drum 9. In the phase shown in FIG. 2, the transfer drum 9 rotates in the direction of rotation represented by the curved arrow 38, i.e., the direction of rotation which is critical for a recto/verso operating mode. The holding element 12, which has gripped the trailing edge 1.1 of the sheet 1, conveys the latter in the direction of rotation represented by the curved arrow 38 along the theoretical gripper circle 10 on the transfer drum 9. Here, the printed upper side 6 is directed towards the transfer drum 9, while the underside 7 of the sheet 1 is directed outwardly. The position 28 designates the pivoting movement of the reversing-drum gripper 15 on the collision-free path 31 and on the enveloping curve of the reversing drum 14. The pivoting movement which is impressed upon the trailing edge 1.1 of the sheet 1 by the movement of the reversing-drum gripper 15 is about 180°.

Figure 3:
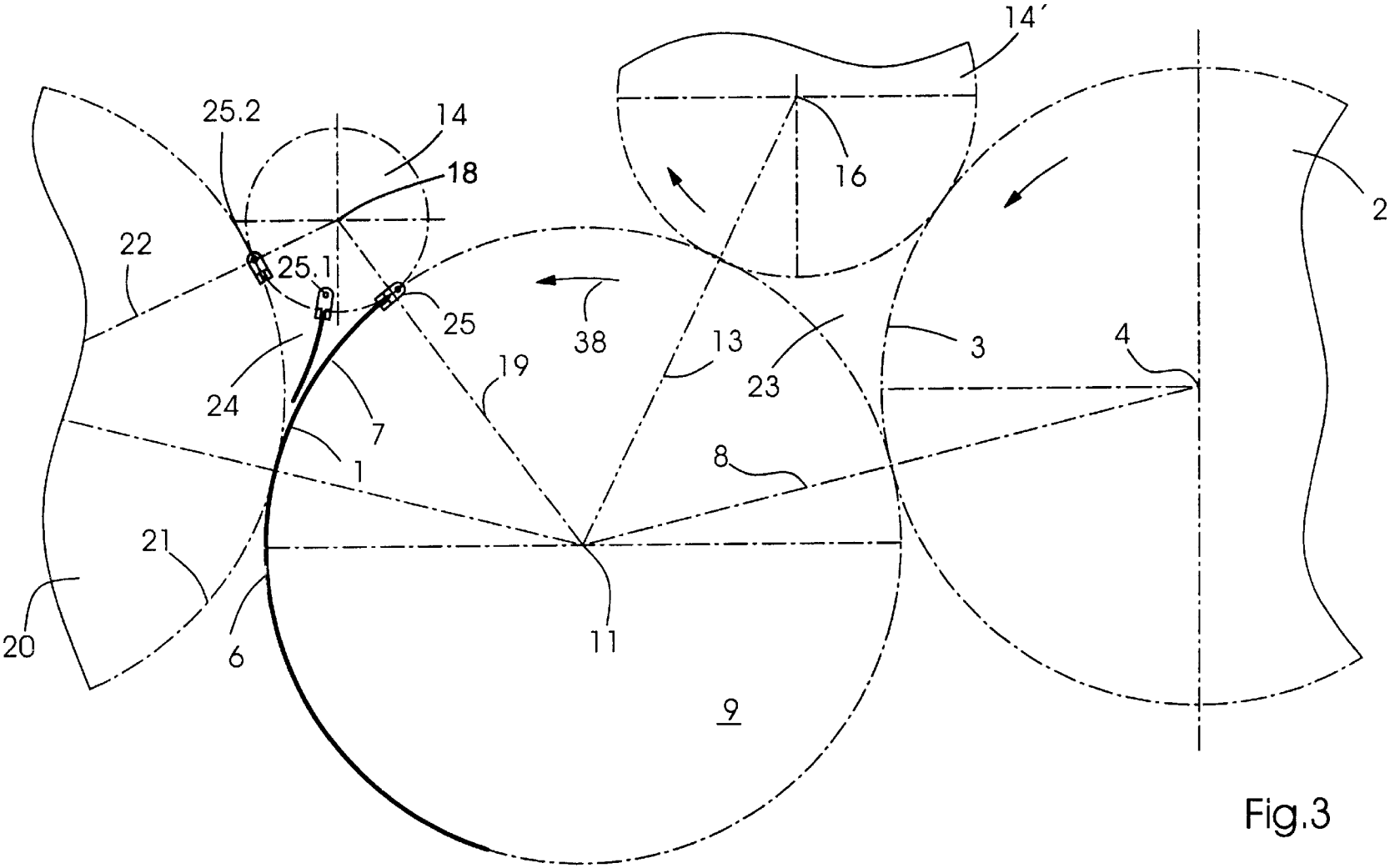
FIG. 3 is a view like that of FIG. 1 of a different embodiment of the cylinder configuration with a half-revolution cylinder.

FIG. 3 shows a different embodiment of a cylinder configuration of a turning or reversing printing unit having half-revolution cylinders. From the outer cylindrical or jacket surface 3 of the first sheet-guiding cylinder 2, the sheet 1 changes over to a transfer drum 9 via a transfer drum 14' rotating about a rotational axis 16. The transfer drum 9 rotates in counterclockwise direction represented by the curved arrow 38, in the recto/verso operating mode. The first transfer center line 8 extends from the rotational axis 11 of the transfer drum 9 to the rotational axis 4 of the first sheet-guiding cylinder 2. A first wedge-shaped region or pocket 23 is bounded by the outer cylindrical or jacket surface 3 of the first sheet-guiding cylinder 2, on the other side by the theoretical gripper circle 10 of the transfer drum 9 and by the outer cylindrical or jacket surface of the drum 14'. Between the transfer center line 13 between the cylinder 14' and the transfer drum 9, and a transfer center line 19 between the reversing or turning drum 14 and the transfer drum 9, the sheet material is transferred to gripping devices (not specifically illustrated here), before the sheet 1, with the upper side 6 thereof directed outwardly and the underside 7 thereof directed towards the rotational axis 11 of the transfer drum 9, is gripped by reversing-drum grippers 25 which are accommodated on the reversing drum 14. Positions 25.1 and 25.2, respectively, are imparted to the trailing edge of the sheet 1 by the reversing-drum grippers 25 of the 25 reversing drum 14. In the alternative embodiment according to FIG. 3, the reversing or turning drum 14, configured with the same diameter as the additional transport element 17 according to FIG. 1, is provided in place of the latter. Rotating about the rotational axis 18, the reversing-drum grippers 25 of the reversing or turning drum 14 transfer the trailing edge of the sheet 1 into the region of the transfer center line 22 between the reversing or turning drum 14 and the second sheet-guiding cylinder 20. As a result, the previously printed upper side 6 of the sheet 1 comes into contact with the outer cylindrical or jacket surface 21 of the second sheet-guiding cylinder 20, while the yet unprinted underside 7 is directed outwardly and, in subsequent printing processes, can be printed in pure recto printing units or else in turning or reversing printing units.

FIG. 4.1 shows in detail an enlarged reproduction of the additional transport element.

The additional transport element 17 limits or bounds by the enveloping curve thereof a wedge-shaped region or pocket 24, which is further bounded by the outer cylindrical or jacket surface 21 of the second sheet-guiding cylinder 20, rotating in counterclockwise direction, and on the other side by the theoretical gripper circle 10 of the transfer drum 9 which, in recto/verso operating mode, rotates in the direction of rotation represented by the curved arrow 38. The old trailing edge 1.1 of the sheet 1 is formed on the transfer center line 19 between the rotational axis 18 of the additional transport element 17 and the axis of rotation 11 of the transfer drum 9. The gripper system 32 of the additional transport element 17 grips the old trailing edge 1.1 of the sheet, so that it is fixed between the movable gripper finger 32 and a pad 36. The gripper fingers 32 are moved about a fixed bearing 35 by a cam roller 33 which, for its part, runs on the contour of a cam 34. The gripper pad 36 and the fixed bearing 35, around which the gripper finger 32 pivots, are accommodated on an arm 30 that swings around the rotational axis 18. FIG. 4.1 further reveals that a conically configured supporting element 64 can be assigned to the additional transport element 17, and is used as a supporting surface for a relatively stiff material to be deflected through about 90° (note FIGS. 7, 7.1 and 7.2). Once the arm 30, which rotates in clockwise direction about the rotational axis 13, has reached the transfer center line 22 to the second sheet-guiding cylinder 20, the sheet 1 is transferred with the old trailing edge 1.1 to gripper systems (not specifically illustrated here) on the outer cylindrical or jacket surface 21 of the second sheet-guiding cylinder 20 for further processing as the sheet 1 passes through the printing units of the rotary press.

FIG. 4.2 shows a transfer drum of half-revolution configuration which, according to this alternative embodiment, functions as a turning or reversing drum. From the outer surface 3 of the first sheet-guiding cylinder 2, the sheet 1 passes over to the storage drum 26 with the upper side 6 of the sheet 1 facing towards the outer cylindrical or jacket surface 27 of the storage drum 26. The storage drum 26 is preferably of single-revolution construction and rotates about a rotational axis 16. Provided on the outer cylindrical or jacket surface 27 of the storage drum 26 are holding devices 29, reproduced only diagrammatically here, which fix the leading edge 1.2 of the sheet 1 on the outer surface 27. The storage drum 26, rotating in clockwise direction, stores the length of the sheet 1 with the leading edge 1.2 leading in front on the outer surface 27, before a tongs-type gripper 25, which is pivotable through a 180° arc and is provided on the theoretical gripper circle 10 of the transfer drum 9 provided with a set-back contour 9, grips the trailing edge 1.1 of the sheet 1. As a result of the rotation of the transfer drum 9 about the rotational axis 11 in the direction of rotation represented by the curved arrow 38, the sheet 1 gripped by the tongs-type gripper element 25 is pulled off the outer surface 27 of the storage drum 26 at the trailing edge 1.1. During the rotation of the transfer drum 9 in the direction of rotation represented by the curved arrow 38, the gripper system of the transfer drum 9, constructed as tongs-type grippers 25, completes a pivoting movement 28 covering about 180°. During the pivoting movement, a phase is reached wherein the underside 7 of the sheet 1 is now directed outwardly in relation to the transfer drum 9, while the upper side 6 is directed towards the rotational axis 11 of the transfer drum 9. In the region of the transfer center line 19 between the rotational axis 11 of the transfer drum and the rotational axis 18 of the additional transport element 17, the sheet 1 goes over to the circumference thereof and, at the transfer center line 22, is transferred to the outer cylindrical or jacket surface 21 of the second sheet-guiding cylinder 20. Thereat, the sheet 1 is positioned in a manner that the printed underside 6 faces towards the outer surface 21 of the it second sheet-guiding cylinder 20, while the yet nonprinted underside 7 faces outwardly. During the rotation of the second sheet-guiding cylinder 20 in counterclockwise direction, the sheet 1 is supplied, with the underside 7 facing outwardly, to further printing units, wherein further printing of the sheet can be carried out.

Alternative embodiments of gripper systems acting on both sides are shown in FIGS. 5.1 to 5.5.

FIG. 5.1 shows, by way of example, a tongs-type gripper 15, 25, 40, which can be accommodated on the transfer drum 9 configured with a set-back contour. The tongs-type gripper has gripper surfaces 43 and is pivotable about a pivot pin or shaft 42. The pivoting movement which the tongs-type gripper 15, 25, 40 executes about the pivot pin 42 thereof is identified by the arcuately configured arrow 28 or 41.

FIG. 5.2 shows a gripper system likewise acting on both sides and formed by a double gripper 44. The gripper fingers of the double gripper are accommodated on a common pivot pin or shaft 42, each gripper finger having a separate gripper pad 45 assigned thereto.

FIG. 5.3 shows a T-shaped gripper 46, to which two gripper pads 45 are likewise assigned underneath a T-shaped crossbar. The vertical inward and outward movement of the T-piece of the T-shaped gripper 46 is impressed on the latter via an articulated lever 47, which is pivotable about a support 48. The pivoting movement of the lever 47 about the support 48 is initiated by a roller 49, which rolls on the contour of a cam 50 reproduced only diagrammatically in this figure.

FIG. 5.4 shows a holding element 12 on the transfer drum 9 which, in recto printing mode 59, assumes a driven-out position thereof about the pivot pin or shaft 42. In a recto/verso operating mode 60, the holding element 12 assumes a dipped position 55 according to FIG. 5.4. To this end, the gripper system as a whole is pivoted about a support 48. The pivoting movement of the gripper system, accommodated on a lever 47, is impressed on the latter by a cam roller 49 which, in turn, runs on a cam contour 56.

A possible alternative construction to collision-free gripper guidance on the transfer drum is provided by a gripper system according to FIG. 5.5. Therein, the gripper system is constructed as a folding gripper which, in recto printing mode 59, cooperates with a seat 58 underneath the theoretical gripper circle 10 of the transfer drum 9. The folding gripper 57 is pivotable about the pin or shaft 42 and, during the pivoting movement thereof, i.e., the dipping thereof below the theoretical gripper circle 10, describes a rotation represented by the double-headed arrow 28 of about 180°.

FIG. 6 shows in detail the paths of the gripper system which result in the recto printing mode and in the recto/verso printing mode, in relation to the theoretical gripper circle 10 of the transfer drum 9.

The cylinder configuration reproduced only diagrammatically in FIG. 6 and including a first sheet-guiding cylinder 2, a transfer drum 9, a turning or reversing drum 14, an additional transport element 17 and a second sheet-guiding cylinder 20 shows that the gripper systems accommodated on the transfer drum 9, when in the recto printing mode 59, describe a path 52 or 53 corresponding to the nominal diameter of the transfer drum 9. In the recto/verso operating mode 60, on the other hand, the gripper systems assigned to the transfer drum 9 are set back into a gripper path 54 which retreats behind the theoretical gripper circle 10, i.e., the gripper systems are set back behind the nominal diameter 52 of the transfer drum 9. Collision-free operation of the transfer drum as the sheet-guiding drum in the recto printing mode is thus ensured.

The sequence of FIGS. 7, 7.1 and 7.2 illustrates diagrammatically in detail a conical supporting element which can be accomodated both on the transfer drum 9 and/or on an additional transport element 17. The additional transport element 17 and the transfer drum 9, respectively, are accommodated in the bearing 69 in side walls 61 and 62, respectively, of the turning or reversing printing unit configured in accordance with the invention. The drive occurs on a shaft 63 via a gear provided on the drive side 61. The conical supporting elements 64 formed with beveled faces 68 are positioned, in relation to the transfer drum 9 and the additional transport element 17, respectively, in a manner that they engage under a relatively stiff material 65, such as cardboard or pasteboard, in a side region of the latter. By a catching or capturing device 66, reproduced only diagrammatically in FIG. 7, the side edges of the relatively stiff cardboard 65 are pressed against the beveled faces 68 of the conical supporting elements 64, so that the relatively stiff material 65 can be transferred from a stretched position, i.e., a position projecting from the circumferential surface, into a curvature corresponding to the curvature of the circumferential surface of the transfer drum 9 and the additional transport element 17, respectively.

FIG. 7.1 shows the contact region of the catching element 66 with the lateral surfaces of the relatively stiff sheet material 65 in an enlarged scale. The catching element 66, constructed in the shape of a catching hook, experiences a pivoting movement 67 about a pivot axis, during which movement the catching element 66 is transferred from an open position 72 to a closed position 73. In the starting or set-on state 73 of the catching hook 66, the latter, acting on the underside 7 of the relatively stiff sheet material 65, presses the edge regions of the printed upper side 6 against the inclined contact faces 68 of the conical or cone-shaped supporting element 64.

FIG. 7.2 shows that the relatively stiff sheet material 65 is transferred from a stretched position 70 into an approximately wound-up position 71 by the action of engaging or setting the catching element 66 on. As a result, a risk of collision between the trailing region of the relatively stiff sheet material or cardboard 65 and other stationarily accommodated machine components is reduced. The contact faces 68 of the conical or cone-shaped supporting element 64 may be accommodated particularly preferably on a transfer drum 9 or on an additional transport element 17 in the shape of a transport cylinder.

Figure 8:
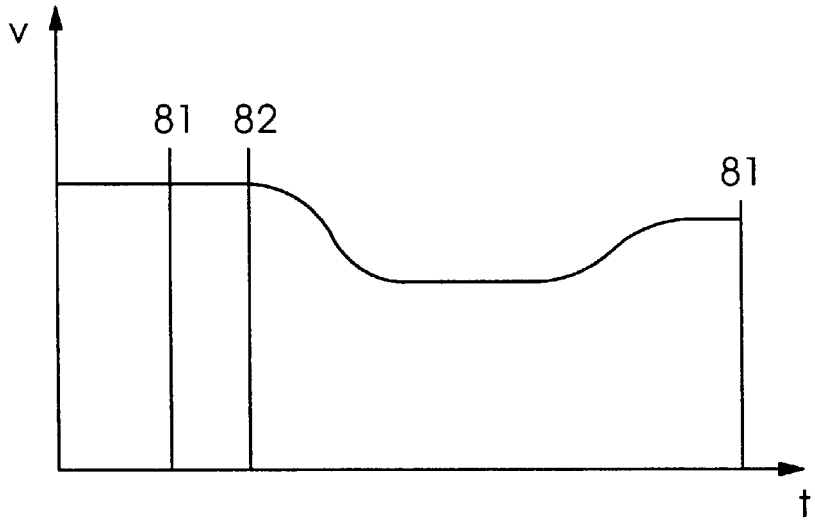
FIG. 8 is a speed per time plot diagram or graph for the additional transport element having, for example, a cylindrical configuration.

FIG. 8 shows in detail a speed/time graph of an additional transport element. Reference numeral 81 identifies the transfer of a sheet, whether it is paper of heavier or lighter grammage, or cardboard 65. The sheet transfer speed is identified by reference numeral 82, the circumferential speed of the arm 30 of the additional transport cylinder experiencing a dip after the sheet transfer 82, in order to be accelerated to sheet transfer speed again shortly before the next sheet transfer 81 of the following copy, whether it is a sheet 1 of paper or a relatively stiff printing material such as cardboard or pasteboard 65.

Figure 9:
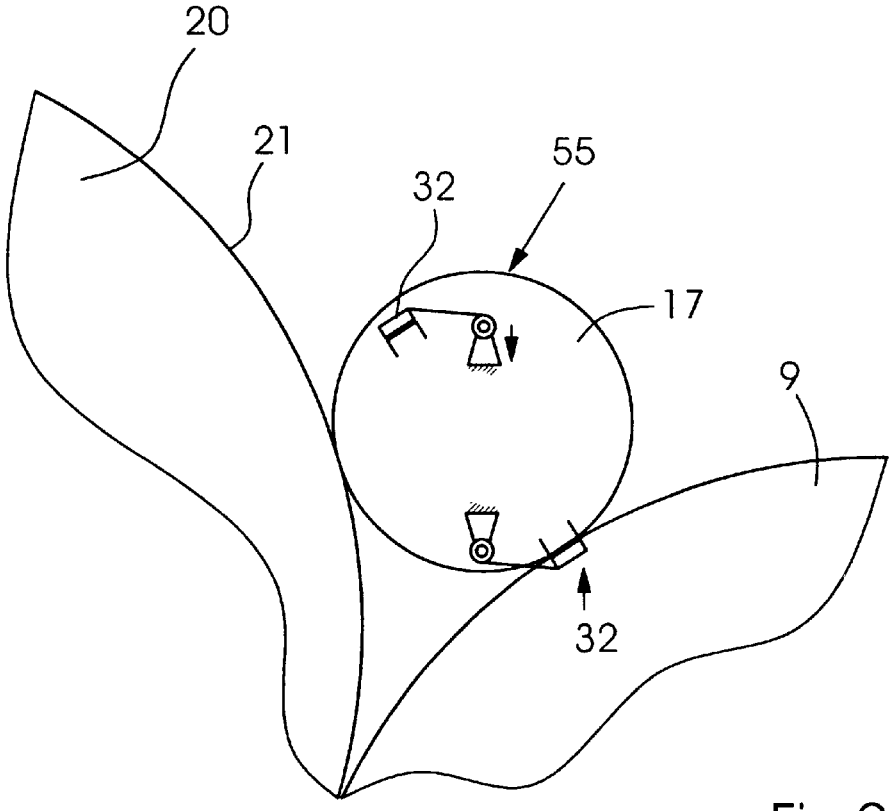
FIG. 9 is a fragmentary view of another embodiment of the additional transport element, which is accommodated between the second sheet-guiding cylinder and the transfer drum, the additional transport element being constructed with integral divisions of the diameter of the printing-form cylinder.

FIG. 9 shows in detail, in a diagrammatic reproduction, a view of an additional transport element which is accommodated between the second sheet-guiding cylinder and the transfer drum and which is constructed in an integral division of the diameter of the printing-form cylinder. This transport cylinder 17, constructed with a very small diameter for reasons of installation space, includes, on the circumferential surface thereof, gripper elements 32 which dip into the circumferential surface or move out of it. The gripper elements 32 can assume a position 55 set back behind the outer surface of the additional transport element 17 or can emerge from the outer surface of the transport cylinder 17 and thus take sheet material 1, 65 from the transfer drum 19 and transfer it to the outer surface 21 of a second sheet-guiding cylinder 20. Accordingly, in a manner similar to that on the transfer drum 9, gripping elements 32 which withdraw behind the outer surface can also be accommodated on the additional transport element 17 in the shape of a transport cylinder.

Figure 10:
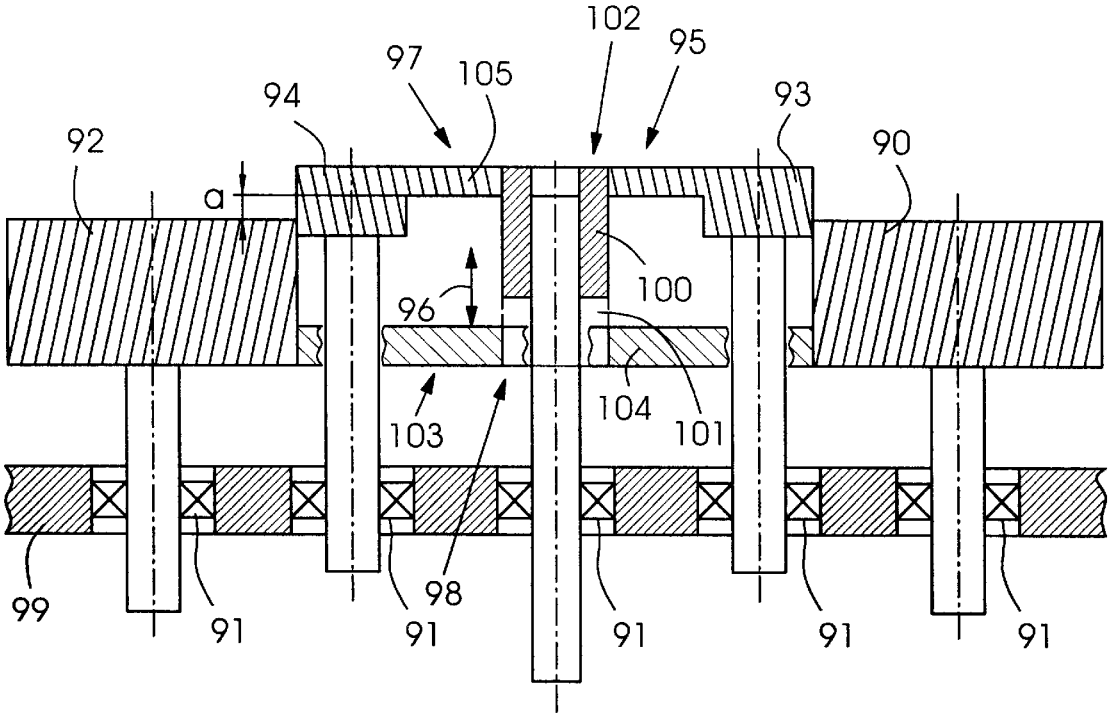
FIG. 10 is a sectional view of the gear trains together with a coupling element for driving the turning or reversing printing unit configured in accordance with the invention, both in pure recto printing mode and in recto/verso printing mode.

FIG. 10 shows in detail the gear trains together with a coupling element for driving the turning or reversing printing unit configured in accordance with the invention in recto printing mode and also in recto/verso printing mode.

The gear train, wherein the turning or reversing printing unit configured in accordance with the invention may be operated in recto/verso mode, is identified by reference numeral 102, whereas reference numeral 103 identifies the drive course which is established in pure recto printing operation of the turning or reversing printing unit. The individual shafts of the first sheet-guiding cylinder 2, the reversing or turning drum, the transfer drum, the additional transport element and the second sheet-guiding cylinder are all rotatably accommodated in a side wall 99 of the turning or reversing printing unit, using bearings 91 which are reproduced only diagrammatically here.

In the recto printing mode 59, the drive of the three half-revolution cylinders 1, 9 and 20 runs via the gear train 103. The gear 90 of the first sheet-guiding cylinder 2, a drive gear 104 accommodated on the shaft of the transfer drum 9 and the gear 92, which serves to drive the second sheet-guiding cylinder 20, mesh with one another. The drive gears 93 and 94 of the turning or reversing drum and the additional transport element are stopped, i.e., are disengaged from the drive train. In the recto/verso operating mode 60, the drive is provided from the drive gear 90 of the first sheet-guiding cylinder 2 to the gear 93, which is used to drive the turning or reversing drum 14. From the latter, the drive goes via the gear 105 arranged on the shaft of the transfer drum 9 to the drive gear 94 of the additional transport element 17, and from the latter to the drive gear 92 of the second sheet-guiding cylinder. In this alternative embodiment, the gear 104 accommodated on the shaft of the transfer drum 14 is displaced by the actuating travel distance a or 96 and brought out of engagement with the gears 90 and 92.

By the coupling element 95, an engaged phase 97 and a disengaged phase 98 can be achieved. On the shaft of the transfer drum 9, for example, one of the gears 105 and 104, respectively, can be displaced in the axial direction, represented by the actuating travel 96, so that the distance a for engagement or disengagement corresponds exactly to one gear width. The sleeve-like element 100, to the circumference of which the outer gear 105 of the shaft of the transfer drum 9 is fixed, moves back into a broken-line position 101, so that effective disengagement of the gear 104 from the drive gears 90 and 92 of the first and second sheet-guiding cylinder 1, 20 is ensured.

By this selection of the drive gears, the changeover from recto printing mode 59 to recto/verso printing mode 60 is carried out by coupling, i.e., shifting the clutch between direct and indirect drive via the turning or reversing drum 14 to the transfer drum 9. In this regard, at the same time, the drive systems rotate in relation to one another in a manner that the turning or reversing drum 14 grips the end of the sheet 1, 65, respectively, lying on the impression cylinder exactly, depending upon the format. In the recto printing mode 59, the drive is provided so that the gears 93 and 94, which are required in the recto/verso operating mode 60, are in a rest position, disengaged from the turning or reversing drum 14 and the additional transport element 17.

I claim:

1. In a sheet-processing rotary printing machine operatable in recto printing and recto/verso printing modes, a device for reversing sheets, comprising a transfer drum bounded by two sheet-guiding cylinders, a reversing/storage drum and an additional transport element assigned to said transfer drum, said transfer drum being drivable in opposite directions of rotation in the recto printing and the recto/verso printing modes, and gripper systems actable in both directions of rotation of said transfer drum, said gripper systems being accommodated on an imaginary jacket surface of said transfer drum.

2. The sheet-reversing device according to claim 1, wherein said reversing/storage drum and said additional transport element, in the recto printing mode, are located outside a transport path of a sheet on said sheet-guiding cylinders.

3. The sheet-reversing device according to claim 1, wherein a transport path of a sheet, in the recto/verso printing mode, is located on a side of a jacket surface of said transfer drum, which is located opposite said transport path of the sheet in the recto printing mode.

4. The sheet-reversing device according to claim 1, wherein said transfer drum has a contour set back with respect to an enveloping curve of said gripper systems.

5. The sheet-reversing device according to claim 1, wherein said reversing/storage drum and said additional transport element are driven only in the recto/verso printing mode, and are stopped in the recto printing mode.

6. The sheet-reversing device according to claim 3, wherein said two sheet-guiding cylinders are first and second sheet-guiding cylinders, said transfer drum is drivable in a direction opposite to the direction of rotation of the recto printing mode, said reversing/storage drum and said additional transport element engaging with said second one of said sheet-guiding cylinders serving for transporting and reversing the sheet in the recto/verso printing mode.

7. The sheet-reversing device according to claim 3, wherein, in the recto/verso printing mode, said transport path of the sheet is over a first one of said sheet-guiding cylinders, a single-revolution transfer cylinder, said transfer drum drivable in a direction opposite to the direction of rotation of the recto printing mode, and said additional transport element functioning as a reversing drum.

8. The sheet-reversing device according to claim 3, wherein, in the recto/verso printing mode, said transport path of the sheet extends from a first one of said sheet-guiding cylinders over said storage drum, said transfer drum functioning as a reversing drum, over said additional transport element to the jacket surface of a second one of said sheet-guiding cylinders.

9. The sheet-reversing device according to claim 1, wherein a first one of said sheet-guiding cylinders, said transfer drum and a second one of said sheet-guiding cylinders are constructed as half-revolution cylinders.

10. The sheet-reversing device according to claim 1, wherein said reversing/storage drum and said additional transport element are constructed by a technique selected from the group thereof consisting of a single revolution and a division by integers in relation to the diameter of a printing form cylinder.

11. The sheet-reversing device according to claim 1, wherein said gripper systems act on both sides on said transfer drum, and are formed as tongs-type gripper systems for executing a 180° pivoting movement.

12. The sheet-reversing device according to claim 1, wherein said gripper systems act on both sides on said transfer drum and are formed, respectively, as a double gripper with two gripper fingers drivable about a common shaft.

13. The sheet-reversing device according to claim 1, wherein said gripper systems act on both sides on said transfer drum and are formed, respectively, as a cam-controlled, vertically displaceable T-shaped gripper to which two gripper pad surfaces are assigned.

14. The sheet-reversing device according to claim 1, wherein said gripper systems accommodated on said transfer drum are constructed as gripper systems activatable in the recto printing mode, and settable into a dipped position in the recto/verso printing mode.

15. The sheet-reversing device according to claim 1, wherein said gripper systems accommodated on said transfer drum are constructed as folding gripper systems pivotable about a pivot shaft.

16. The sheet-reversing device according to claim 1, wherein a supporting element having an inclined contact face is accommodated on at least one of said transfer drum and said additional transport element, and including a catching element activatable for setting relatively stiff sheet material against said supporting element.

17. The sheet-reversing device according to claim 16, wherein said relatively stiff sheet material is transferrable by said catching device from a stretched position into a wound-up position on said supporting element.

18. The sheet-reversing device according to claim 1, wherein, in the recto printing mode, a drive to one of said sheet-guiding cylinders is provided via a gear train.

19. The sheet-reversing device according to claim 1, wherein, in the recto/verso printing mode, a drive to the other of said sheet-guiding cylinders is provided via another gear train having a coupling element.

20. A printing unit for reversing sheet material, comprising a transfer drum bounded by two sheet-guiding cylinders, a reversing/storage drum and an additional transport element assigned to said transfer drum in the printing unit, said transfer drum being drivable in opposite directions of rotation in recto printing and recto/verso printing modes, and gripper systems actable in both directions of rotation off said transfer drum, said gripper systems being accommodated on an imaginary jacket surface of said transfer drum.

21. In a multicolor rotary printing machine having a device for reversing sheets, an improvement comprising a transfer drum bounded by two sheet-guiding cylinders, a reversing/storage drum and an additional transport element assigned to said transfer drum in the printing machine, said transfer drum being drivable in opposite directions of rotation in recto printing and recto/verso printing modes, and gripper systems actable in both directions of rotation of said transfer drum, said gripper systems being accommodated on an imaginary jacket surface of said transfer drum.

* * * * *